US008091153B2

(12) United States Patent
Martin

(10) Patent No.: US 8,091,153 B2
(45) Date of Patent: Jan. 10, 2012

(54) DOUBLE FLOW FLUSHING SYSTEM WITH MAGNETIC VALVE

(75) Inventor: Christian Martin, St Martin I'Hortier (FR)

(73) Assignee: CELEC Conception Electronique, Neufchatel-en-Bray (FR)

( * ) Notice: Subject to any disclaimer, the term of this patent is extended or adjusted under 35 U.S.C. 154(b) by 146 days.

(21) Appl. No.: 12/727,514

(22) Filed: Mar. 19, 2010

(65) Prior Publication Data

US 2010/0235977 A1 Sep. 23, 2010

(30) Foreign Application Priority Data

Mar. 23, 2009 (FR) ..... 09 51820

(51) Int. Cl.
*A47K 13/00* (2006.01)

(52) U.S. Cl. ..... 4/234

(58) Field of Classification Search ..... 4/324, 300, 4/236, 227.1, 363, 410, 407, 405, 415; 451/461; 264/279.1, 86; 426/29; 137/426, 414; 417/20; 73/861.74; 29/33 R
See application file for complete search history.

(56) References Cited

U.S. PATENT DOCUMENTS

| | | | |
|---|---|---|---|
| 5,842,236 | A | 12/1998 | Piat |
| 2007/0204393 | A1 | 9/2007 | Martin |

FOREIGN PATENT DOCUMENTS

| | | |
|---|---|---|
| DE | 24 12 780 | 9/1975 |
| DE | 196 18 645 | 12/1997 |
| FR | 2 724 190 | 3/1996 |
| FR | 2 872 184 | 12/2005 |
| WO | 95/33102 | 12/1995 |

OTHER PUBLICATIONS

French Search Report dated Dec. 14, 2009, from corresponding French application.

*Primary Examiner* — Lori Baker
(74) *Attorney, Agent, or Firm* — Young & Thompson

(57) ABSTRACT

A device (10) for opening a toilet flushing system including a water cistern (12) supplied by a filler valve, and having a bottom discharge orifice (14) and a vertical movable discharge valve element (15) associated with this orifice (14) which is capable of occupying a low closed position for keeping the water in the cistern (12) or a high open position for discharging the water to a toilet pan, a float (18) which, when the cistern (12) is full, is submerged in order to move the valve element (15) to its open position, and a rod (22) for blocking the valve element (15) capable of being blocked or released by a magnetic valve and a finger at two emptying levels of the cistern.

17 Claims, 4 Drawing Sheets

DOUBLE FLOW FLUSHING SYSTEM WITH MAGNETIC VALVE

Figure 1:
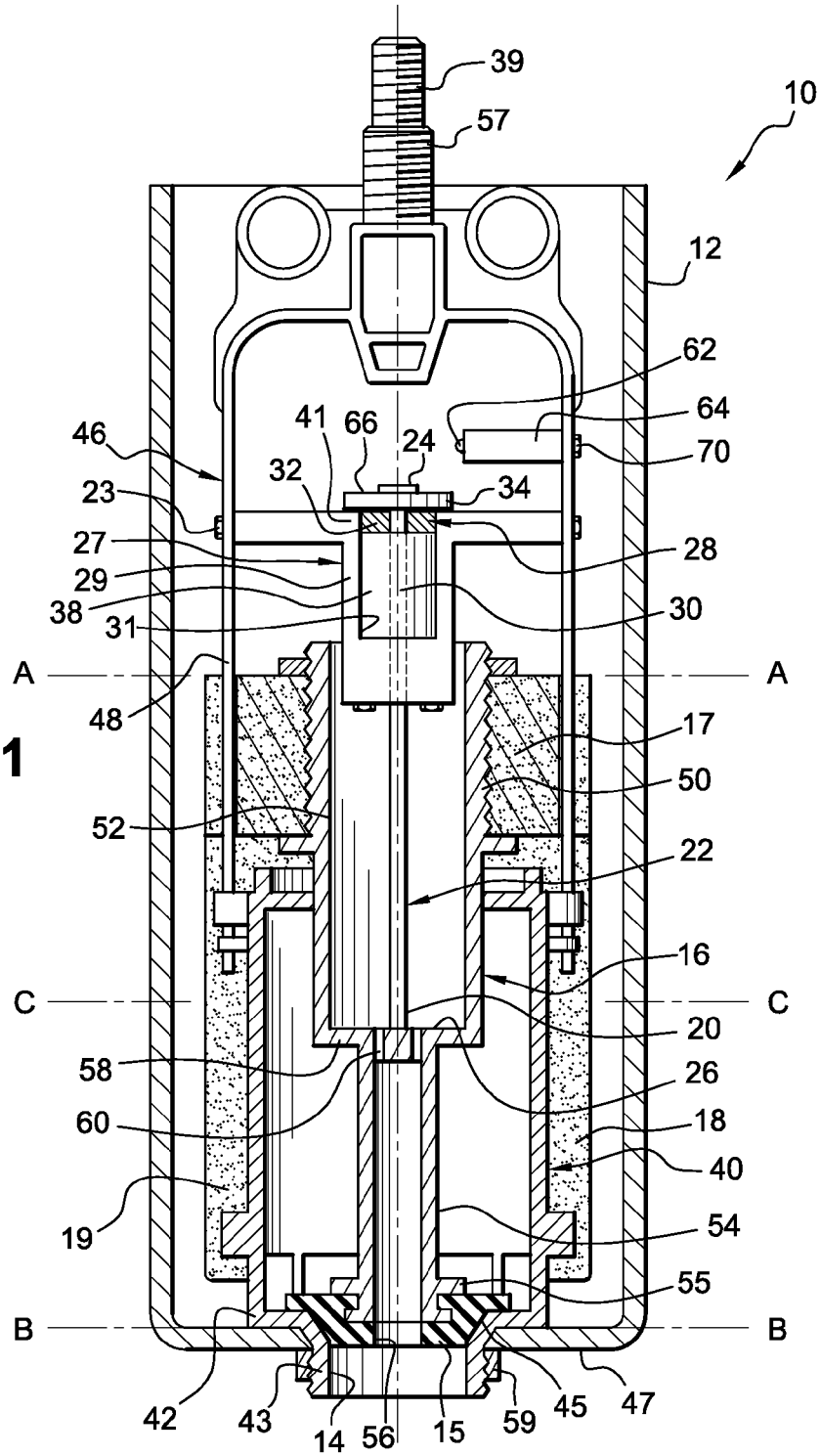

The invention relates to a device for opening toilet flushing systems.

The invention relates more particularly to a device for opening toilet flushing systems, which comprises a water cistern supplied by a valve connected to a water-distribution system, and which is capable of being opened in order to cause the cistern to be filled when the water level descends below a determined to bottom limit, and of the type which comprises a bottom discharge orifice and a vertical movable discharge valve element associated with this orifice, which is capable of occupying a low closed position in order to keep the water inside the cistern or a high open position in order to discharge the water to a toilet pan, and of the type which comprises an element, secured to the valve element and comprising a float, which is capable of moving the valve element to its open position under the effect of buoyancy when at least a determined fraction of the float is submerged, a top bearing face of said element being capable of being selectively blocked or unblocked by a free bottom end of a vertical blocking rod, substantially coaxial with the element, a free top end of which comprises a metal plate, and which can be moved vertically between:

- a blocked position, in which a permanent magnet, secured to the cistern, arranged facing the metal plate of the rod, retains the metal plate under the influence of its permanent magnetic field in order to keep the blocked rod in contact with the top bearing face of the element, in order to immobilize the element,
- an unblocked position, in which a first solenoid, arranged close to the permanent magnet, is controlled electrically to oppose a temporary field to the magnetic field created by the permanent magnet and thus release the metal plate from the rod in order to release the element, so that the said element can be moved between:

- a bottom position for closing the full cistern, associated with the blocking of the element by the rod against the buoyancy effect being applied to the float, in which the said element closes the valve element,
- a top position for opening the cistern, associated with the unblocked position of the element by the rod, in which the float, emerging to the maximum, operates the element in order to open the valve element, the rod accompanying the element over to a determined maximum travel,
- a bottom position for closing the empty cistern, prior to a new blocking of the element by the rod, in which the said element closes the valve element.

Several toilet flushing system devices are known in which a device, which uses the buoyancy principle, makes it possible to transmit a thrust from a submerged float to a valve element for opening the cistern by means of an element.

In such devices, the float and the element are usually immobilized by means of a locking mechanism and, when they are released, they are capable of transmitting their rising movement to the valve element in order to open the said valve.

The locking mechanism can easily be made of a permanent magnet interacting with a metal plate. The magnetic field generated by the permanent magnet can easily be cancelled out by a solenoid or electromagnet operating at low voltage and in a standalone manner, in order to unlock the element furnished with the float and therefore the valve element.

This configuration makes it possible in particular to propose flushing systems with automatic control which, when the user leaves the toilet, automatically trigger the actuation of the element for opening the cistern in order to discharge the water into the toilet pan.

Conventionally, the element secured to the valve element rises until the float emerges to the maximum. The cistern is then emptied fully until the float, deprived of water to hold it up, causes the valve element to fall back onto its seat.

It will be understood that this design causes the cistern to be fully emptied, even though only a reduced quantity of water is required.

The invention remedies this drawback by proposing an enhancement of a device of the type described above allowing a partial emptying of the cistern.

For this purpose, the element is blocked in a determined to position of its upward travel and the permanent magnet is dimensioned so as to cause a magnetic attraction closing the valve element before the water has fully emptied.

For this purpose, the invention proposes a device for opening toilet flushing systems of the type described above, is characterized in that it comprises a transverse retractable abutment finger, which is capable of being interposed selectively at right angles to the rod in order to limit the travel of the rod to a determined portion of its maximum travel, in order to limit the rise of the element to an intermediate open position of the cistern in which the float emerges only partly by moving the element in order to open the valve element, and from which the element returns to its reclosure position when the joint forces of the weight of the element and of the rod, moved to its blocking position by the permanent magnet, overcome the buoyancy effect being exerted on the float, so as to discharge only a portion of the water from the cistern to the toilet pan.

According to other features of the invention:

- the retractable finger is moved by a second solenoid between a position set back from the travel of the metal plate and an abutment position in which it extends at right angles to the travel of the metal plate in order to block a top face of the metal plate,
- the device comprises a support, secured to the cistern and being substantially "U"-shaped, in a concavity of which the permanent magnet and the first solenoid, with substantially cylindrical shapes, are received, the rod passing through the said permanent magnet, the said first solenoid and a horizontal branch of the said support.
- the element is substantially tubular, coaxial with the valve element, a bottom end of the said element comprises the valve element, and the blocking rod is coaxial with the element,
- the cistern comprises a cage which comprises:
  - a tubular bottom portion, of which a bottom-end to threaded bearing surface passes through a piercing of the cistern in order to attach the said bottom portion, which comprises internally the discharge orifice, and in which the element is slidingly mounted,
  - a top portion in the shape of an inverted "U", the arms of which are attached to the tubular bottom portion, and between the said arms of which the support is attached, and the top portion of the tubular element, which protrudes from the tubular bottom portion of the cage between the arms of the top portion of the cage, receives the float,

- the second solenoid is supported by an arm of the top portion of the cage,
- the float is substantially in the shape of an inverted "U", the horizontal branch of which passes through the arms of the top portion of the cage, the lateral arms of which surround the bottom portion of the cage, and the float is attached to the top portion of the element, notably by interlocking, the float is made of expanded polystyrene and the top portion of the element comprises, on its outer periphery, teeth designed to promote the coupling by interlocking of the float to the element, the element comprises:

the tubular top portion, inside which at least the bottom end of the rod is received, a tubular bottom portion, of which a bottom end receives the valve element which is associated with the discharge orifice and which is made notably of elastomer, a transverse inner wall, delimiting the tubular top portion and the tubular bottom portion, pierced with at least one orifice forming an overflow, and the valve element comprises at least one end piercing with a diameter that is smaller than the discharge orifice in order to allow the water from the orifice forming an overflow to be discharged, the inner transverse wall comprises the top bearing face of the element.

The invention also relates to a method for controlling a device of the type described above.

This method comprises a step of discharging all of the water from the cistern, during which a brief electric pulse is sent into the first solenoid.

As a variant, this method comprises a step of discharging a portion of the water from the cistern, during which the second solenoid is powered and then a brief electric pulse is sent into the first solenoid.

Figure 2:
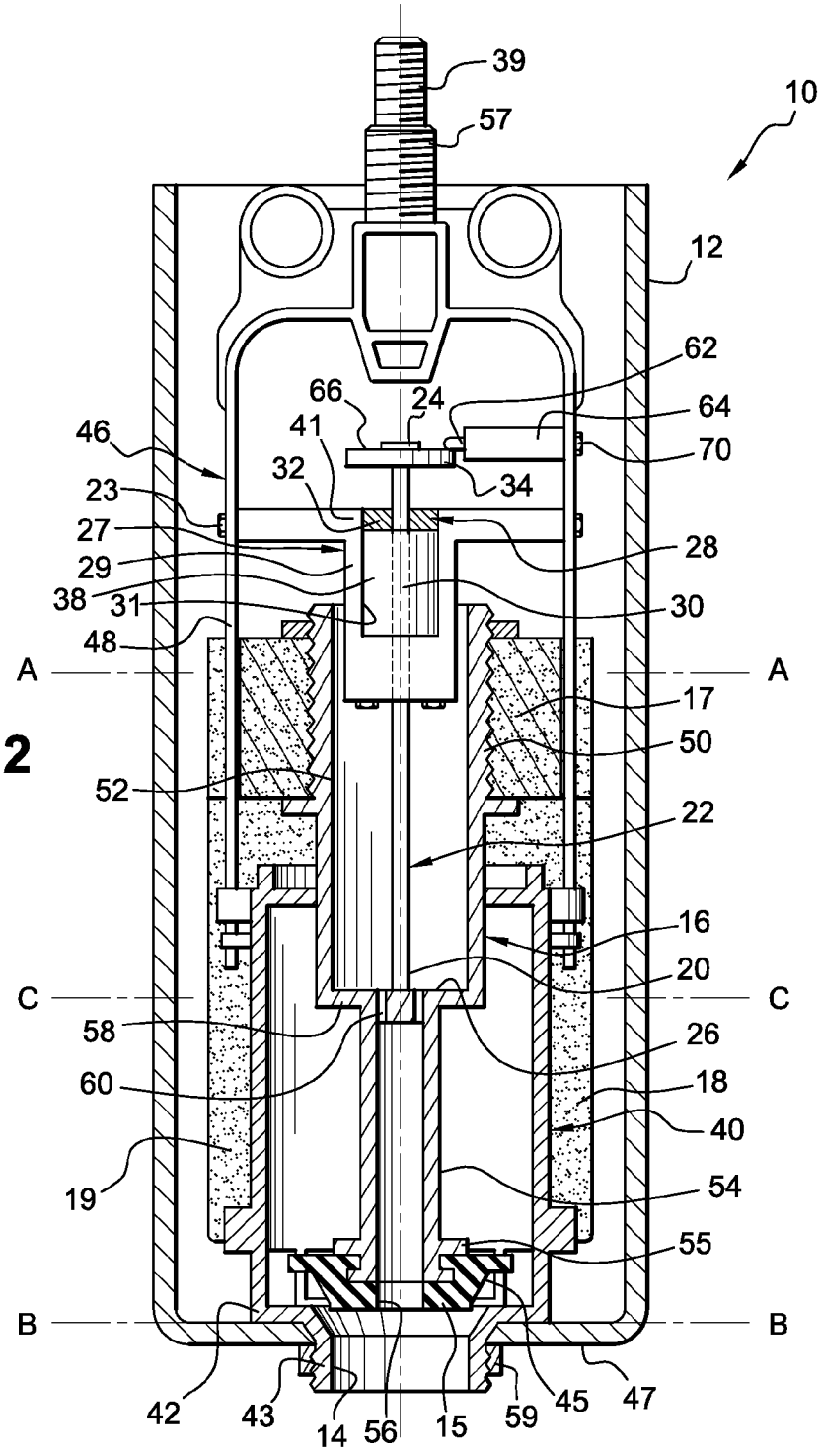
Figure 3:
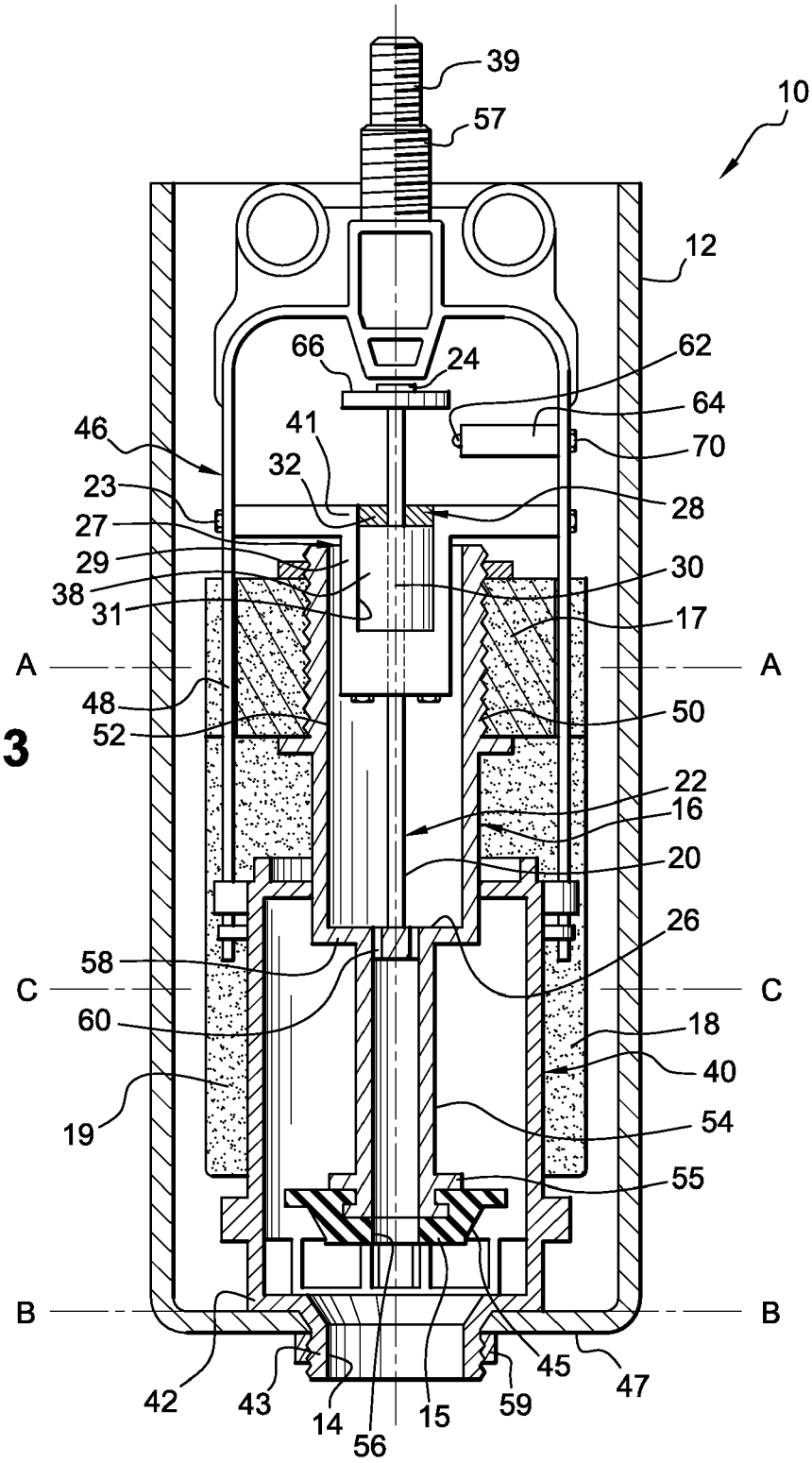
Figure 4:
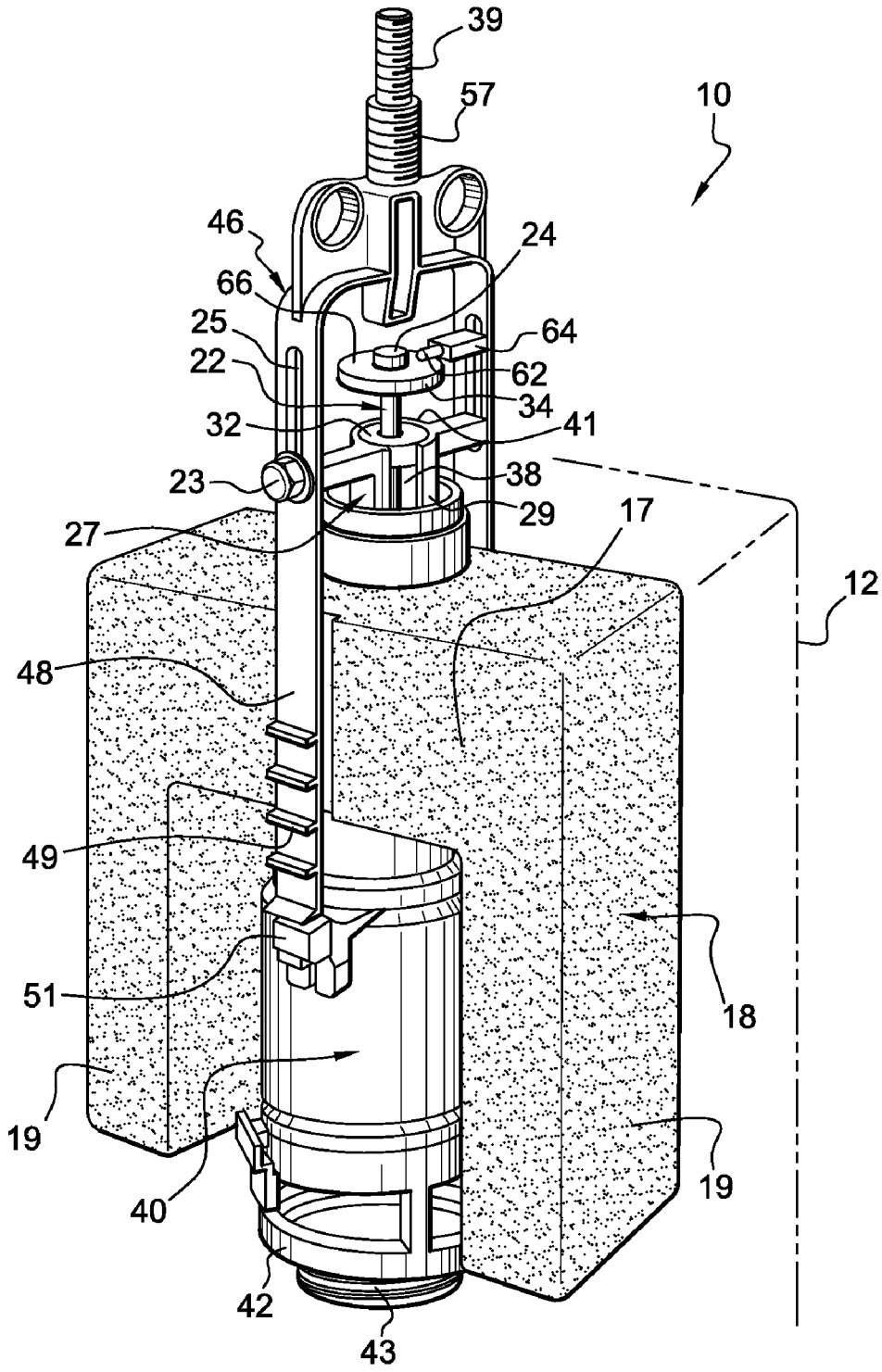

Other features and advantages of the invention will appear on reading the following detailed description, for the understanding of which reference will be made to the appended drawings in which:

FIG. 1 is a schematic view in section representing a device according to the invention in the position of closure of the full cistern, of closure of the empty cistern, or in the position of reclosure of the at least partially emptied cistern, FIG. 2 is a schematic view in section representing a device according to the invention in the intermediate position of opening of the cistern, FIG. 3 is a schematic view in section representing a device according to the invention in the top open position of the cistern, FIG. 4 is a view in perspective of the device according to the invention.

In the following description, elements that are identical or have similar functions bear the same reference numbers.

FIGS. 1 to 3 show the whole of a device 10 for opening the toilet flushing system produced according to the invention.

In a known manner, as illustrated more particularly in FIGS. 1 to 3, the device 10 comprises a water cistern 12 which is supplied by a valve (not shown) which is connected to a water distribution system.

In a known manner, as illustrated in FIG. 1, this valve is capable of being opened to fill the cistern 12 when the water level descends below a determined bottom limit "B". The valve is designed to close automatically when the water level reaches a top limit "A".

The cistern 12 comprises a bottom discharge orifice 14 and a vertical movable discharge valve element 15 which is associated with this orifice 14.

In a known manner, the valve element 15 is capable of occupying a closed low position, which has been shown in FIG. 1, to keep the water inside the cistern 12 or a high open position, which has been shown in FIG. 3, in order to discharge the water to a toilet pan (not shown).

In a known manner, the device 10 comprises an element 16, secured to the valve element 15 and comprising a float 18, which is capable of moving the valve element 15 to its open position of FIG. 3 under the well-known buoyancy effect.

The float 18 then exerts a lifting force on the element 16, caused by the buoyancy, when at least a determined fraction of the float 18 is submerged.

In a known manner, a top bearing face 26 of the said element 16 is capable of being selectively blocked or unblocked by a free bottom end 20 of a vertical blocking rod 22, substantially coaxial with the element 16, a free top end 24 of which comprises a metal plate 34.

The top end 24 of the rod 22 may in particular be threaded and pass through the metal plate 34 to which it is attached by a nut.

According to this configuration, the rod 22 can occupy a blocking position, shown in FIG. 1, in which a top face 32 of a permanent magnet 28 secured to the cistern, arranged facing the metal plate 34 of the rod 22, retains the metal plate 34 under the influence of its permanent magnetic field in order to keep the blocked rod 22 in contact with the top bearing face 26 of the element 16, in order to immobilize the said element 16.

The permanent magnet 28 therefore forms a "magnetic suction cup" capable of retaining the rod 22.

In the preferred embodiment of the invention, and in a non-limiting manner of the latter, as shown in FIGS. 1 to 3, the permanent magnet 28 is traversed by a vertical section 30 of the rod 22. It will be understood that the vertical section 30 of the rod 22 can occupy any configuration close to the permanent magnet without being limited in any manner by the configuration which has been described only as an example.

The rod 22 may also occupy an unblocking position shown in FIGS. 2 and 3, in which a first solenoid 38, arranged close to the permanent magnet 28, is controlled electrically to oppose a temporary field to the magnetic field created by the permanent magnet 28 and thus release the metal plate 34 of the rod which is thus capable of leaving its contact with the top face 32 of the permanent magnet 28, thus releasing the element 16.

In this way, when the solenoid 38 is electrically powered, the temporary field of the solenoid 38 opposes the permanent field of the permanent magnet 28. This releases the metal plate 34 from the top face 32 of the permanent magnet 28.

The movable rod 22 can move between these two positions.

These movements of the rod therefore allow the element 16 to move between various positions.

As illustrated in FIG. 1, the element 16 can occupy a bottom closed position of the full cistern 12, in which the water level contained in the cistern corresponds substantially to the line "A" of FIG. 1.

This position is associated with the blocking of the element 16 by the rod 22 against the buoyancy effect exerted on float 18, and allows the said element 16 to close the valve element 15.

As illustrated in FIG. 3, the element 16 can occupy a top open position of the cistern 12, associated with the unblocked position of the element 16 by the rod 22, in which the float 22, emerging to the maximum, moves the element 16 to open the valve element 15, the rod 22 accompanying the element 16 on a determined maximum travel.

From this position, the element 16 accompanied by the rod 22 can redescend provided that the water level in the cistern descends from the level shown by the line "A" to the level shown by the line "B".

Therefore, as illustrated in FIG. 1, the element 16 can then occupy a bottom position for closing the empty cistern 12, in which the water level contained in the cistern corresponds substantially to the line "B" of FIG. 1.

This position corresponds to a new blocking of the element 16 by the rod 22 before the cistern 12 is refilled and therefore before the buoyancy effect applies again to the float 18.

Therefore, in its simplest operation, the device 10 for opening a flushing system makes it possible, in a known manner, to empty the whole content of the cistern 12 via the valve element 15.

It is nevertheless desirable to be able to propose with this type of device 10 a partial emptying of the cistern 12, a possibility provided by other known devices of the prior art not operating according to the principle of an opening of the valve element by buoyancy.

It has been noted that, if, on the one hand, the permanent magnet 28 is dimensioned adequately and can apply a sufficiently powerful magnetic field to the metal plate 34, and, on the other hand, the float 18 does not initially emerge fully, the element 16 could occupy, as again illustrated by FIG. 1, a bottom position for reclosing the cistern 12 that is at least partially emptied, in which the buoyancy effect exerted on the float 18 does not sufficiently oppose the joint forces of the weight of the element 16 and of the rod 22, moved to its blocking position by the permanent magnet 28.

In this case, the valve element 15 can therefore be closed while the water level in the cistern 12 is midway between the levels shown by the lines "A" and "B" and corresponds for example to the level "C".

This property can be used to discharge only a portion of the water from the cistern 12 to the toilet pan.

To apply this property, the invention proposes a device 10 of the type described above, characterized in that it comprises a transverse retractable abutment finger 62, which is capable of being interposed selectively at right angles to the rod 22 in order to limit the travel of the rod 22 to a determined portion of its maximum travel, in order to limit the rise of the element 16 to an intermediate open position of cistern, represented in FIG. 2.

In this position, the float 18 only emerges partially while moving the element 16 in order to open the valve element 15, and consequently from this position the element 16 can return to a bottom position for reclosing the at least partially emptied cistern, shown in FIG. 1, in which the joint forces of the weight of the element 16 and of the rod 22, moved to its blocking position by the permanent magnet 28, overcome the buoyancy effect exerted on the float 18, so that the element 16 closes the valve element 15.

It will be understood that at the time of the closure of the valve element 15, there is therefore still in the cistern a quantity to of water corresponding to the level illustrated by the line "C". The emptying of the cistern 12 has therefore been only partial.

More particularly, the retractable finger 62 is moved by a second solenoid 64, between a position set back from the travel of the metal plate 34, as shown in FIGS. 1 and 3, and an abutment position, shown in FIG. 2, in which it extends at right angles to the travel of the metal plate 34 in order to block a top face 66 of the metal plate 34.

Very simply, the finger 62 can be cylindrical and received in a solenoid of toroidal shape, but this configuration is clearly not limiting of the invention.

In the preferred embodiment of the invention, the device 10 comprises a support 27, secured to the cistern 12 and being substantially "U"-shaped, the branches 29 of which determine a concavity 31 in which the permanent magnet 28 and the first solenoid 38 of substantially cylindrical shape are received. The rod 22 passes through the permanent magnet 28, the first solenoid 38 and a horizontal branch 41 of the support.

Moreover, the element 16 is substantially tubular and is coaxial with the valve element 15. A bottom end 55 of the element 16 comprises the valve element 15 and the blocking rod 22 is also coaxial with the element 16.

This configuration is in no way limiting of the invention, but it makes it possible to limit to the maximum the radial space requirement of the device 10.

To hold the element 16, the permanent magnet 18 and the rod 22, the cistern 12 comprises a cage 40 which comprises a tubular bottom portion 42, of which a bottom-end threaded bearing surface 43 passes through a piercing 45 of the cistern 12 and is attached under a bottom face 47 of the cistern by means of a nut 59. This configuration attaches the said bottom portion 42 to the cistern 12.

The bottom portion 42 of the cage 40 comprises the discharge orifice 14 and the element 16 is slidably mounted to inside the bottom portion 42 in order to selectively close off or uncover the discharge orifice 14.

The cage 40 also comprises a top portion 46 in the shape of an inverted "U", the top arms 48 of which are attached to the bottom portion 42. The top arms 48 receive the support 27 and comprise, at their bottom ends, notches 49 allowing them to be adjusted in height in eyelets 51 of the bottom portion 42.

A top portion 52 of the tubular element 16, which protrudes from the tubular bottom portion 42 of the cage 40 between the arms 48 of the top portion 46 of the cage 40, receives the float 18.

Advantageously, the second solenoid 64 is supported by one of the arms 48 of the top portion 46 of the cage 40.

It will be noted that the arms 48 each comprise slots 25 designed to receive screws 23 for fastening the support 27 and a screw 70 for fastening the second solenoid 64. This configuration makes it possible to adjust the height of the support 27 and above all to adjust the height of the solenoid 64, which makes it possible to determine the quantity of water that can be partially emptied.

It will be noted that the top portion 46 may advantageously comprise a thread 57 for the attachment of electronic accessories (not shown) and a coaxial thread 39 for the attachment of a cover (not shown) of the cistern.

Moreover, the float 18 has substantially the shape of an inverted "U" the horizontal branch 17 of which passes through the top arms 48 of the top portion 46 of the cage 40, and the lateral arms 19 of which surround the bottom portion 42 of the cage 40. The float 18 is attached at its horizontal branch 17 to the top portion 52 of the element 16, notably by interlocking.

More particularly, the float 18 is made of expanded polystyrene. To attach the float 18 and the valve element 16, the top portion 52 protruding from the element 16 comprises teeth 50 designed to promote the coupling of the float 18 to the element 16.

Advantageously, the element 16 comprises the tubular top portion 52, inside which at least the bottom end 20 of the rod 22 is received.

The element 16 also comprises a tubular bottom portion 54, a bottom end of which receives the valve element 15 associated with the discharge orifice 14. The valve element 15 is for example made of elastomer.

The element 16 finally comprises an inner transverse wall 58, delimiting the tubular top portion 52 and the tubular bottom portion 54, which is pierced with at least one orifice 60 forming an overflow. This orifice 60 is designed to allow water to pass into the element 16 in the direction of a central piercing 56 of the valve element 15. This piercing 56 has a smaller diameter than the discharge orifice 14 in order to allow the discharge of the water.

Advantageously, the inner transverse wall 58 comprises the top bearing face 26 of the element 16 which is designed to receive the rod 22 in contact and the orifice 60 is placed radially relative to the point of contact of the rod 22.

For this purpose, the rod 22 has an appropriate length.

The bearing face 26 may comprise several orifices 60, distributed angularly in an even manner around the rod 22.

If the valve becomes jammed in the open position, the water overflows via the top end of the top portion 52 of the element 16 and is discharged through the orifice 60 and the piercing 56 into the toilet pan preventing the cistern 12 from overflowing.

In this configuration, it will be understood that a method for controlling such a device 10 may comprise a step of discharging all of the water from the cistern during which a brief electric pulse is sent into the first solenoid 38, which has the effect of temporarily releasing the rod 22 and of allowing the element 16 and the valve element 15 to rise under the buoyancy effect applied to the float 18, until the float 18 emerges to the maximum, as shown in FIG. 3.

The method comprises a step as a variant of discharging a portion of the water from the cistern, during which the second solenoid 64 is powered and then a brief electric pulse is sent into the first solenoid 38 which has the effect of temporarily releasing the rod 22 and of allowing only a partial rise of the element 16 and the valve element 15 under the buoyancy effect applied to the float 18, up to the position of abutment against the finger 62 as shown in FIG. 2.

Therefore, the valve element 15 being open, the water level reduces in the cistern 12; consequently the force exerted by the buoyancy effect on the float 18 reduces progressively.

At a given moment, the attraction of the permanent magnet 28 combined with the weight of the element 16 is greater than the force exerted by the buoyancy effect on the float 18, which causes the element 16 to descend and the valve element 15 to close before all of the water has been emptied from the cistern.

An electronic control element (not shown), which is attached to the thread 57, can be used for example to release the rod 22 and/or block it by sending an electric pulse to the first solenoid 38 and by powering the second solenoid 64. Batteries may for example power a cascade of modules, comprising an electronic detection module which transmits an item of information, relative to the presence or absence of a user, to an amplification module, which transmits this item of information to a central processing unit which determines the time of presence of the user and, when the presence of the user is no longer detected after a certain time, triggers the transmission of a pulse to a module for controlling the solenoid 38, which provides an electric pulse to the said solenoid 38 so that the latter releases the rod 22 and causes the flushing system to empty.

Naturally, in this configuration, the device is adjusted selectively so as to produce a total or partial emptying of the cistern 12.

As can be seen, this device 10 for opening a flushing system is particularly advantageous since it makes it possible to use only elements powered at a low voltage supplied by batteries, the buoyancy forming the main source of energy for all of the forces that consume much energy.

The invention claimed is:

1. Device (10) for opening toilet flushing systems, which comprises a water cistern (12) supplied by a valve connected to a water-distribution system, and which is capable of being opened in order to cause the cistern (12) to be filled when the water level descends below a determined bottom limit (B), the said cistern comprising a bottom discharge orifice (14) and a vertical movable discharge valve element (15) associated with this orifice (14), which is capable of occupying a low closed position in order to keep the water inside the cistern (12) or a high open position in order to discharge the water to a toilet pan, and the said device comprising an element (16), secured to the valve element (15) and comprising a float (18), which is capable of moving the valve element (15) to its open position under the effect of buoyancy when at least a determined fraction of the float (18) is submerged, a top bearing face (26) of said element (16) being capable of being selectively blocked or unblocked by a free bottom end (20) of a vertical blocking rod (22), substantially coaxial with the element (16), a free top end (24) of which comprises a metal plate (34), and which can be moved vertically between:

a blocking position, in which a permanent magnet (28) secured to the cistern (12), arranged facing the metal plate (34) of the rod (22), retains the metal plate (34) under the influence of its permanent magnetic field in order to keep the blocked rod (22) in contact with the top bearing face (26) of the element (16), in order to immobilize the element (16), an unblocked position, in which a first solenoid (38), arranged close to the permanent magnet (28), is controlled electrically to oppose a temporary field to the magnetic field created by the permanent magnet (28) and thus release the metal plate (34) from the rod (22) in order to release the element (16), so that the said element (16) can be moved between:

a bottom position for closing the full cistern (12), associated with the blocking of the element (16) by the rod (22) against the buoyancy effect being applied to the float (18), in which the said element (16) closes the valve element (15), a top position for opening the cistern (12), associated with the unblocked position of the element (16) by the rod (22), in which the float (18), emerging to the maximum, operates the element (16) in order to open the valve element (15), the rod (22) accompanying the element over a determined maximum travel, a bottom position for closing the empty cistern (12), prior to a new blocking of the element (16) by the rod (22), in which the said element (16) closes the valve element (15), characterized in that it comprises a transverse retractable abutment finger (62), which is capable of being interposed selectively at right angles to the rod (22) in order to limit the travel of the rod (22) to a determined portion of its maximum travel, in order to limit the rise of the element (16) to an intermediate open position of the cistern (12) in which the float (18) emerges only partly by moving the element (16) in order to open the valve element (15), and from which the element (16) returns to a bottom position of reclosing the at least partially emptied cistern (12), in which position the joint forces of the weight of the element (16) and of the rod (22), moved to its blocking position by the permanent magnet (28), overcome the buoyancy effect being exerted on the float (18), so that the element (16) closes the valve element (15), so as to discharge only a portion of the water from the cistern (12) to the toilet pan.

2. Device (10) according to claim 1, characterized in that the retractable finger (62) is moved by a second solenoid (64) between a position set back from the travel of the metal plate (34) and an abutment position in which it extends at right angles to the travel of the metal plate (34) in order to block a top face (66) of the metal plate (34).

3. Device (10) according to claim 2, characterized in that it comprises a support (27), secured to the cistern (12) and being substantially "U"-shaped, in a concavity (31) of which the permanent magnet (28) and the first solenoid (38), with substantially cylindrical shapes, are received, the rod (22) passing through the said permanent magnet (28), the said first solenoid (38) and a horizontal branch (41) of the said support.

4. Device (10) according to claim 1, characterized in that the element (16) is substantially tubular, coaxial with the valve element (15), in that a bottom end (55) of the said element (16) comprises the valve element (15), and in that the blocking rod (22) is coaxial with the element (16).

5. Device (10) according to claim 4, characterized in that the cistern (12) comprises a cage (40) which comprises:

a tubular bottom portion (42), of which a bottom-end threaded bearing surface (43) passes through a piercing (45) of the cistern (12) in order to attach the said bottom portion (42), which comprises internally the discharge orifice (14), and in which the element (16) is slidingly mounted, a top portion (46) in the shape of an inverted "U", the arms (48) of which are attached to the tubular bottom portion (42), and between the said arms (48) of which the support (27) is attached, and in that the top portion (52) of the tubular element (16), which protrudes from the tubular bottom portion (42) of the cage (40) between the arms (48) of the top portion (46) of the cage (40), receives the float (18).

6. Device (10) according to claim 5, characterized in that the second solenoid (64) is supported by an arm (27) of the top portion (46) of the cage (40).

7. Device (10) according to claim 5, characterized in that float (18) is substantially in the shape of an inverted "U", the horizontal branch (17) of which passes through the arms (48) of the top portion of the cage (40), the lateral arms of which surround the bottom portion (42) of the cage (40), and in that the float (18) is attached to the top portion (52) of the element (16), notably by interlocking.

8. Device according to claim 7, characterized in that the float (18) is made of expanded polystyrene and in that the top portion (52) of the element (16) comprises, on its outer periphery, teeth (50) designed to promote the coupling by interlocking of the float (18) to the element (16).

9. Device (10) according to claim 6, characterized in that the element (16) comprises:

the tubular top portion (52), inside which at least the bottom end (20) of the rod (22) is received, a tubular bottom portion (54), of which a bottom end (55) receives the valve element (15) which is associated with the discharge orifice (14) and which is made notably of elastomer, a transverse inner wall (58), delimiting the tubular top portion and the tubular bottom portion, pierced with at least one orifice (60) forming an overflow, and in that the valve element (15) comprises at least one end piercing (56) with a diameter that is smaller than the discharge orifice (14) in order to allow the water from the orifice (60) forming an overflow to be discharged.

10. Device (10) according to claim 9, characterized in that the transverse inner wall (58) comprises the top bearing face (26) of the element.

11. Method for controlling a device (10) according to claim 1, characterized in that it comprises a step of discharging all of the water from the cistern (12), during which a brief electric pulse is sent into the first solenoid (38).

12. Method for controlling a device (10) according to claim 1, characterized in that it comprises a step of discharging a portion of the water from the cistern, during which the second solenoid (64) is powered and then a brief electric pulse is sent into the first solenoid (38).

13. Device (10) according to claim 2, characterized in that the element (16) is substantially tubular, coaxial with the valve element (15), in that a bottom end (55) of the said element (16) comprises the valve element (15), and in that the blocking rod (22) is coaxial with the element (16).

14. Device (10) according to claim 3, characterized in that the element (16) is substantially tubular, coaxial with the valve element (15), in that a bottom end (55) of the said element (16) comprises the valve element (15), and in that the blocking rod (22) is coaxial with the element (16).

15. Device (10) according to claim 6, characterized in that float (18) is substantially in the shape of an inverted "U", the horizontal branch (17) of which passes through the arms (48) of the top portion of the cage (40), the lateral arms of which surround the bottom portion (42) of the cage (40), and in that the float (18) is attached to the top portion (52) of the element (16), notably by interlocking.

16. Device (10) according to claim 7, characterized in that the element (16) comprises:

the tubular top portion (52), inside which at least the bottom end (20) of the rod (22) is received, a tubular bottom portion (54), of which a bottom end (55) receives the valve element (15) which is associated with the discharge orifice (14) and which is made notably of elastomer, a transverse inner wall (58), delimiting the tubular top portion and the tubular bottom portion, pierced with at least one orifice (60) forming an overflow, and in that the valve element (15) comprises at least one end piercing (56) with a diameter that is smaller than the discharge orifice (14) in order to allow the water from the orifice (60) forming an overflow to be discharged.

17. Device (10) according to claim 8, characterized in that the element (16) comprises:

the tubular top portion (52), inside which at least the bottom end (20) of the rod (22) is received, a tubular bottom portion (54), of which a bottom end (55) receives the valve element (15) which is associated with the discharge orifice (14) and which is made notably of elastomer, a transverse inner wall (58), delimiting the tubular top portion and the tubular bottom portion, pierced with at least one orifice (60) forming an overflow, and in that the valve element (15) comprises at least one end piercing (56) with a diameter that is smaller than the discharge orifice (14) in order to allow the water from the orifice (60) forming an overflow to be discharged.

* * * * *